US010302365B2

(12) United States Patent
Gerges et al.

(10) Patent No.: US 10,302,365 B2
(45) Date of Patent: May 28, 2019

(54) HEAT EXCHANGER APPARATUS WITH MANIFOLD COOLING

(71) Applicant: Dana Canada Corporation, Oakville (CA)

(72) Inventors: Ihab Edward Gerges, Oakville (CA); John G. Burgers, Oakville (CA); Peter Zurawel, Mississauga (CA); Zia Shahidi, Mississauga (CA); Kosta Bozhkov, Burlington (CA)

(73) Assignee: Dana Canada Corporation, Oakville, Ontario (CA)

( * ) Notice: Subject to any disclaimer, the term of this patent is extended or adjusted under 35 U.S.C. 154(b) by 1212 days.

(21) Appl. No.: 14/188,070

(22) Filed: Feb. 24, 2014

(65) Prior Publication Data

US 2014/0238641 A1 Aug. 28, 2014

Related U.S. Application Data

(60) Provisional application No. 61/768,324, filed on Feb. 22, 2013.

(51) Int. Cl.
*F28D 9/00* (2006.01)
*F28F 19/00* (2006.01)
(Continued)

(52) U.S. Cl.
CPC ..... *F28D 9/005* (2013.01); *F02M 26/32* (2016.02); *F28D 9/0037* (2013.01);
(Continued)

(58) Field of Classification Search
CPC ..... F28D 9/0043; F28D 9/0093; F28D 9/005; F28D 9/0037; F02M 26/32
See application file for complete search history.

(56) References Cited

U.S. PATENT DOCUMENTS 2,045,657 A 6/1936 Karmazin
2,059,114 A 10/1936 Karmazin
(Continued)

FOREIGN PATENT DOCUMENTS

CN 1476527 A 2/2004
CN 201476661 U 5/2010
(Continued)

OTHER PUBLICATIONS

International Search Report with Written Opinion for PCT/CA2014/050123.
(Continued)

*Primary Examiner* — Jon T. Schermerhorn, Jr.
(74) *Attorney, Agent, or Firm* — Marshall & Melhorn, LLC

(57) ABSTRACT

Disclosed is a heat exchanger having heat exchange plates and a base plate that can help to mitigate the thermal stresses encountered by a heat exchanger, particularly, around the peripheral edge portions of the heat exchanger and the base of heat exchanger. This is achieved by providing a channel of coolant fluid near the peripheral edge portions which is in between the peripheral edge portions and the manifold permitting flow of hot fluid. In addition, the base plate of the heat exchanger is protected from the hot fluid flowing through the manifold by providing deflectors that shield the base plate from the hot fluid.

21 Claims, 11 Drawing Sheets

(51) Int. Cl.
*F02M 26/32* (2016.01)
*F28D 21/00* (2006.01)

(52) U.S. Cl.
CPC ..... *F28D 9/0056* (2013.01); *F28D 21/0003* (2013.01); *F28F 19/002* (2013.01); *F28F 2265/10* (2013.01)

(56) References Cited

U.S. PATENT DOCUMENTS

| | | | | |
|---|---|---|---|---|
| 3,525,391 | A | 8/1970 | Day | |
| 5,794,691 | A * | 8/1998 | Evans | F28D 1/0333 165/153 |
| 6,530,425 | B2 | 3/2003 | Wehrmann et al. | |
| 6,997,250 | B2 | 2/2006 | Dilley et al. | |
| 2010/0193169 | A1* | 8/2010 | Yamada | F28D 9/005 165/167 |
| 2011/0226445 | A1 | 9/2011 | Brand | |
| 2013/0061584 | A1 | 3/2013 | Gerges et al. | |

FOREIGN PATENT DOCUMENTS

| | | | |
|---|---|---|---|
| JP | 2000310497 | A | 11/2000 |
| JP | 2001355978 | A | 12/2001 |
| JP | 2000310497 | A | 4/2002 |
| JP | 2001355978 | A | 5/2003 |

OTHER PUBLICATIONS

English Abstract of JP2001355978.
English Abstract of JP2000310497.
Chinese Office Action of CN Application No. 201480010007.X dated Jan. 18, 2017 with English Translation.
English Abstract of JP2000310497A.
English Abstract of JP2001355978A.
English Abstract of CN 201476661U.
English Abstract of CN1476527A.

* cited by examiner

HEAT EXCHANGER APPARATUS WITH MANIFOLD COOLING

CROSS-REFERENCE TO RELATED APPLICATION

This application claims the benefit of and priority to U.S. provisional application No. 61/768,324 filed Feb. 22, 2013, and having the title HEAT EXCHANGER WITH MANIFOLD COOLING AND DEFLECTOR. The content of the above patent application is hereby expressly incorporated herein by reference into the detailed description thereof.

FIELD

The specification relates to a heat exchanger and a heat exchanger plate having means for reducing thermal stress around the manifold.

BACKGROUND

Thermal stresses can be created in self-enclosed heat exchangers (i.e. stacked plate heat exchangers with integral manifolds, where the fluids are self-contained and do not require an outer housing) where manifolds for hot fluids are provided on the outer periphery of a plate stack, while central portions of the plate stack are cooled by circulation of a coolant. The hot fluid manifolds are in contact with the hot fluid and are significantly hotter than the central areas of the stack, which are in constant contact with a coolant. Consequently, there is a significant surface temperature difference at the hot gas inlet manifold between its side adjacent to the peripheral edge of the heat exchanger (outer side) and its side adjacent to the central (main) coolant passage (inner side). Such a thermal gradient in the manifold can result in high thermal stresses at the manifold. A similar issue can occur at the hot gas outlet manifold, however, it can be to a lesser extent, as the gas temperature has typically been reduced upon contact with the heat exchange coolant.

The situation described above can also create a thermal gradient across the plates which may cause thermal stresses. This issue can arise in any situation where a high temperature fluid enters a heat exchanger through uncooled manifolds provided at the outer edges of a plate stack, such as in an EGHR (exhaust gas heat recovery) cooling and charge air cooling, where a hot gas is cooled by a liquid or gaseous coolant.

FIG. 1 shows an example of an EGHR heat exchanger from a related U.S. patent application Ser. No. 13/599,339, filed Aug. 30, 2012, and incorporated herein by reference. In use, the heat exchanger is mounted to an exhaust valve as shown in FIG. 2. The flow of hot exhaust gas and coolant are shown in FIG. 2. An embodiment of the plate of the heat exchanger is shown in FIG. 3. As would be recognized by a person of ordinary skill in the art based on a reading of the specification that although the heat exchanger described herein is with reference to an EGHR heat exchanger, the invention disclosed herein is not particularly limited for use in an EGHR heat exchanger but can be used in separate applications for heat exchange.

Due to design constraints dictated by the valve configuration in an EGHR, and in order to maximize cooling efficiency, the exhaust inlet and outlet manifolds are located at the edges of the heat exchanger core. It will be appreciated that the portions of the stack which are in contact with the coolant will be at a considerably lower temperature than those areas of the stack which are in contact with the hot exhaust gases only (circled in FIG. 2), thereby creating a thermal gradient across the plates making up the stack. In addition, the hot exhaust gas manifold portion located close to the peripheral edges of the heat exchanger plate can be significantly hotter than the hot exhaust gas manifold portion positioned on the inner side of the plate and in contact with the coolant fluid. This can significantly affect the durability of the heat exchanger that is exposed to hot gases, such as the heat exchanger in an EGHR system.

The thermal gradient described with reference to FIG. 2 can result in thermal stresses when the heat exchanger is heated and cooled under normal operating conditions. Also, because the plate stack has hot fluid manifold sections at the plate ends, the hot outer surfaces of the manifolds are exposed to the environment. Sudden contact of the hot outer surfaces of the heat exchanger with water, as when the vehicle is driven in wet conditions, will cause thermal shocks which may produce additional stresses. In addition, when the hot exhaust gas travels along the length of the inlet exhaust gas inlet manifold, the hot exhaust gas impinges directly on the lowest heat exchange base plate at the end of this hot exhaust gas inlet manifold section. As the flow of the hot exhaust gas impinges generally normal to the inlet manifold end portion at the base plate, it leads to a section of the base plate being at a higher temperature than other portions of the base plate, and leads to a thermal gradient and risk of localized material degradation over time due to hot exhaust gas impingement. Moreover, as the hot gas inlet manifold portion of the base plate is cooled to a lesser extent than the cooled core sections of the heat exchanger plates, the thermal gradient and stress on the base plate can be significantly higher.

There is a need in the art for a heat exchanger having uniformly cooled heat exchanger plates and a base plate that can help to reduce the thermal stresses caused by the thermal gradient which results from a hot exhaust gas flowing through the heat exchanger. In addition, there is a need in the art for a means that can help to reduce and/or protect the base plate from the hot exhaust gas impinging on the base plate of a heat exchanger.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 4:
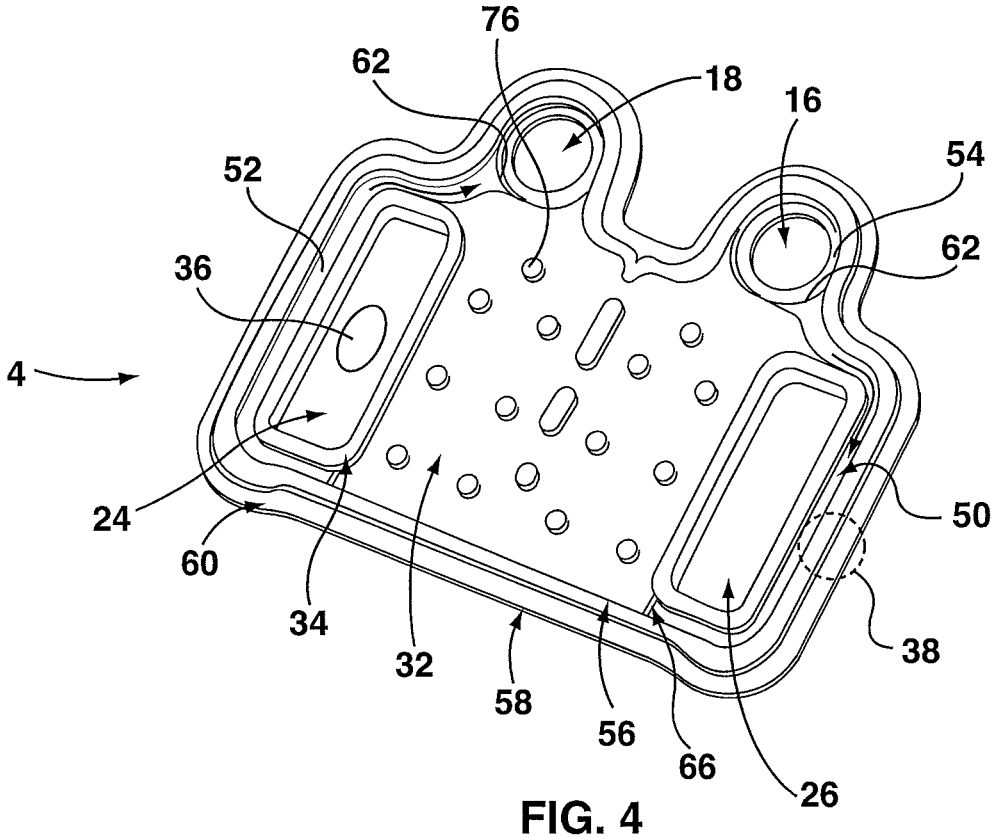
FIG. 4 shows in accordance with an embodiment of the specification a heat exchanger plate of a heat exchanger.

FIG. 4 shows a heat exchanger plate (4) in accordance with an embodiment of the specification. The heat exchanger plate (4) has a passage (32) and a heat exchanger plate first fluid inlet (16) and outlet (18). For the purpose of convenience, features of the heat exchanger plate (4) have been described with respect to the plane of the passage (32) portion of the heat exchanger; with features being described as being below, above or in the plane of the passage (32). As would be recognized by one of skill in the art, such a description is for convenience and features being above would be below, and vice versa, upon turning the plate (4) upside down.

The heat exchanger plate (4) has a pair of bosses (54), with one of the bosses (54) having a heat exchanger plate first fluid inlet (16) and the other boss (54) having a heat exchanger plate first fluid outlet (18). As shown in FIG. 4, the portion of the bosses (54) having the first fluid inlet (16) and outlet (18) are present in a plane below the plane of the passage (32) of the heat exchanger plate (4). In an assembled heat exchanger apparatus (2), as described further herein, a first fluid enters through the first fluid inlet (16), passes over the passage (32) of the heat exchanger plate (4) and exits through the first fluid outlet (18).

The heat exchanger plate (4) is also provided with an embossment (34) having an aperture (36), which can be the heat exchanger plates' second fluid inlet (24) or outlet (26) and permits flow of a second fluid. The heat exchanger plate (4) shown in FIG. 4 has a pair of embossments (34), with one of the embossments (34) having the heat exchanger plate second fluid inlet (24) and the other embossment (34) having the heat exchanger plate second fluid outlet (26), which allow a second fluid flow. In addition, the embossments (34) having the second fluid inlet (24) and outlet (26) are present in a plane above the passage (32) of the heat exchanger plate (4). Consequently, the embossments (34) having the second fluid inlet (24) and outlets (26) protrude in an opposite direction to the bosses (54) having the first fluid inlet (16) and outlets (18). As described herein, the position of the bosses (54) and embossments (34) relative to the passage (32) help to form the first fluid inlet and outlet manifolds (12, 14) and second fluid inlet and outlet manifolds (20, 22), respectively.

Figure 5:
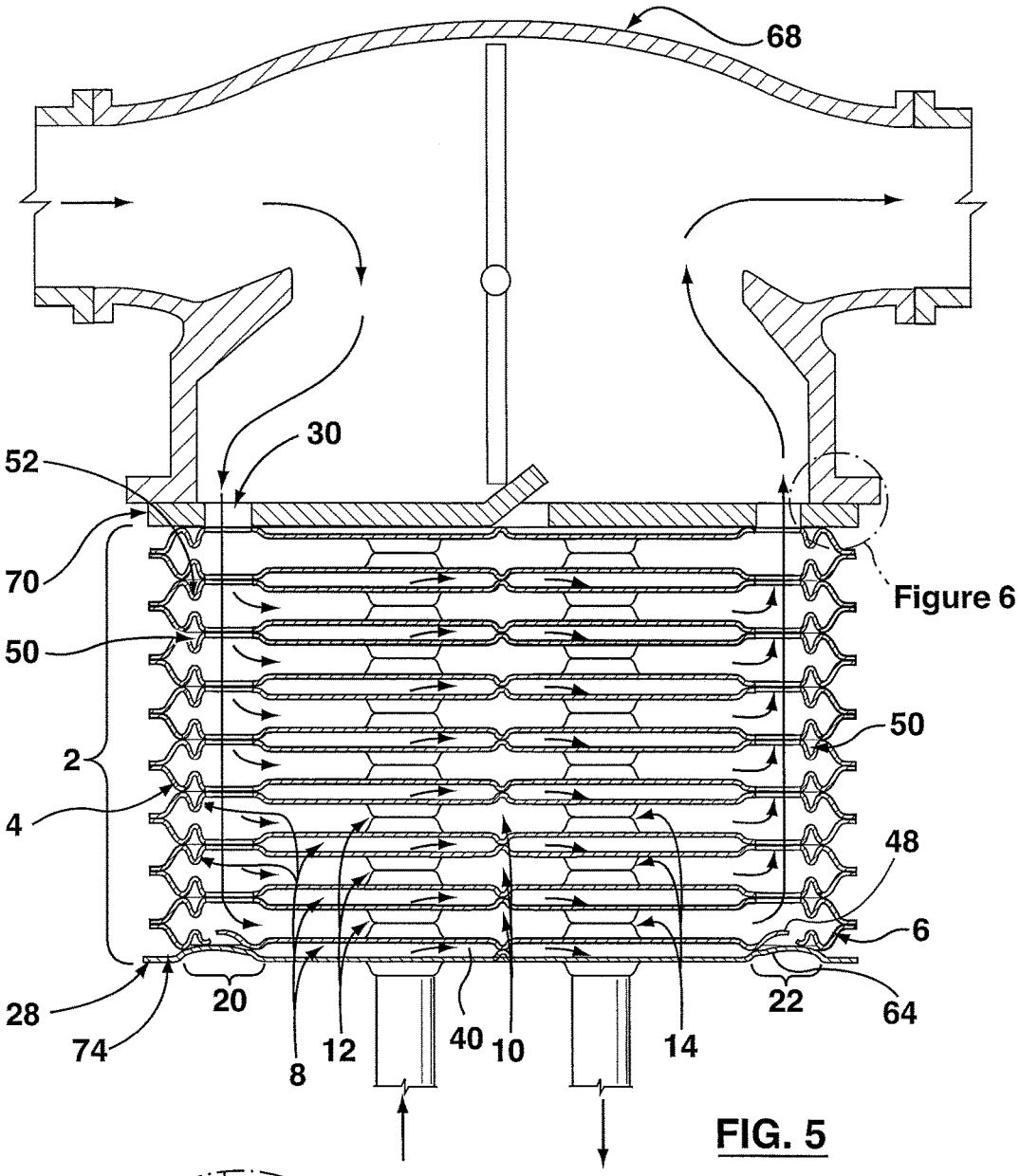
FIG. 5 shows in accordance with an embodiment of the specification a heat exchanger mounted to an exhaust valve.

The heat exchanger plate (4) has a peripheral edge portion (38) that is adapted for operatively coupling of the heat exchanger plate (4) to a second plate, such as, a second heat exchanger plate (4), deflector plate (6) (as described herein) or base plate (74). The peripheral edge portion (38) has a peripheral wall (56) and a peripheral flange (60) extending from the peripheral wall (56) to a peripheral edge (58) of the heat exchanger plate (4). As shown in FIGS. 4 and 5, the peripheral flange (60) lies in a plane below the plane of the passage (32) of the heat exchanger plate (4). While the peripheral wall (56) extends from the peripheral flange (60), in the same direction as the embossments (34) having the second fluid inlet and outlets (24, 26). In other words, the peripheral wall (56) extends from below the plane of the passage (32) to above the plane of the passage (32) of the heat exchanger plate (4); with the upper end of the peripheral wall (56) lying in the same plane as the embossments (34) having the second fluid inlet and outlets (24, 26).

In addition, as shown in FIGS. 4 and 5, the heat exchanger plate (4) is provided with a channel (50) positioned in between the peripheral edge portion (38) and the embossment (34), and permits fluid flow from the first fluid inlet (16) (or to the first fluid outlet (18)) of the heat exchanger plate (4) in between the embossments (34) and the peripheral edge portion (38). The channel (50) has a bed (52), which in one embodiment as shown in the figures, is in a plane below the plane formed by the passage (32) for facilitating preferential flow of a first fluid from the heat exchanger plate first fluid inlet (16) to the channel (50). Consequently, a significant part of the fluid entering the first fluid inlet (16) will flow over into the channel (50) and then flow over the passage (32) of the heat exchanger plate (4).

Similarly, presence of the other channel (50) between the embossment having the second fluid outlet (26) and the peripheral edge portion (38) and having a bed (52) in a plane below the plane of the passage (32), facilitates preferential flow of the first fluid over the passage (32) to the other channel (50) prior to exiting through the first fluid outlet (18). The presence of a channel (50) can help to ensure that area between the embossments (34) having the second fluid inlet (24) and outlet (26) and the peripheral edge portion (38) receives a steady flow coolant (or first fluid), as seen in FIG. 5, and can help to reduce the thermal stress on the heat exchanger plates (4).

The shape, depth, width and other aspects of the channel (50) are not particularly limited and can depend upon the particular design and application requirements. For instance, the plane in which the bed (52) of the channel (50) lies is not particularly limited, and in one embodiment, can be anywhere from being below the plane of the passage (32) of the heat exchanger plate (4) to the plane formed by the portion of the bosses (54) having the first fluid inlet/outlet (16, 18). Further, the width and shape of the channel (50) and bed (52) can be varied so long it allows sufficient fluid flow in between the peripheral edge portion (38) and the embossments (34). In the embodiment shown in the FIG. 4, the bed (52) shown has a flat surface, but other shapes, such as a curved U-shape (as shown in FIG. 5) is also possible.

As the bed (52) of the channel (50) lies in a plane below the plane of the heat exchanger plate passage (32), an indentation (62) can be formed between the first fluid inlet (16) and the channel (50). A similar indentation (62) can be formed between the first fluid outlet (18) and the channel (50). In addition, a step (66) can be provided between the heat exchanger plate passage (32) and the channel (50) that leads to the first fluid outlet (18) (or inlet (16)). Once the first fluid passes over the heat exchanger plate passage (32), the step (66) between the embossment (34) having the second fluid outlet (26) and the peripheral wall (56) can facilitate flow of the first fluid into the channel (50) that leads to the first fluid outlet (18). Consequently, the step (66) can help ensure that a first fluid flows into the second channel (50) before it exits through the first fluid outlet (18). Moreover, as described herein, this can help to reduce the thermal stress between second fluid outlet manifold (22) and the peripheral edge portion (38) of the heat exchanger plate (4).

The shape and position of the indentation (62) and step (66) is not particularly limited, and can depend upon the particular design or application requirements. In one embodiment, for example and without limitation, the indentation (62) and step (66) can vary from being sloped (such as a ramp) to being nearly normal to the plane of the bed (52) of the channel (50). Similarly, the position of the step (66) can vary. In the embodiment shown in FIG. 4, the step (66) is positioned along an edge of the embossment (34) that contacts the heat exchanger plate passage (32), and also being in between the embossment (34) and the peripheral wall (56).

The heat exchanger plate (4) can be provided with one or more dimples (76) that can help to create a turbulent flow over the heat exchanger plate passage (32). The number and shape of the dimples is not particularly limited and can depend upon the particular design or application requirements. Further, the dimples (76) can be replaced with other means, such as, for example and without limitation, a turbulizer, which can help to create a turbulent flow and also assist with heat exchange.

When a pair of heat exchanger plates (4) are placed in a face-to-face relationship (FIG. 5), the peripheral walls (56) of the heat exchanger plates (4) would contact each other. Similarly, the embossments (34) having the second fluid inlet (24) and outlet (26) would also come in contact. This leads to a first fluid conduit (8) that allows a fluid to flow from the heat exchanger plate first fluid inlet (16) to the heat exchanger plate first fluid outlet (18). Similarly, when a pair of heat exchanger plates (4) is placed in a back-to-back relationship, the peripheral flange (60) of the heat exchanger plates (4) would contact each other. In addition, the bosses (54) having the first fluid inlet (16) and outlet (18) would also come in contact. This leads to a second fluid conduit (10) for flow of the second fluid from the second fluid inlet (24) to the second fluid outlet (26) (shown in FIG. 4). Further, as shown in FIG. 5, placing a plurality of heat exchanger plates in such a relationship leads to a first fluid inlet and outlet manifolds (12, 14), and also a second fluid inlet and outlet manifolds (20, 22).

As shown in FIG. 5, when the plates are stacked to form the heat exchanger apparatus (2), hot exhaust gas can enter from an opening (30) in the valve (68) to enter into the hot exhaust gas manifold (second fluid inlet manifold (20)). From here, the hot exhaust gas passes through the second fluid conduits (10) and can undergo heat exchange with the coolant flowing in the first fluid conduits (8) of the heat exchanger (2). It will be understood that the second fluid channels (10) may contain inserted turbulizers, fins, dimples or similar heat transfer augmentation surfaces (not shown), and further optimization of geometry the second fluid conduits can be carried out to improve efficiency of heat exchange. The channels (50) in the heat exchanger (2) allow coolant flow between the hot exhaust gas manifolds and the peripheral edge portion (38) of the heat exchanger plates (4), where heat exchange can also take place.

By providing channels (50) having coolant flow between the second fluid inlet and outlets manifolds (20, 22), and the peripheral edge portion (38) of the heat exchanger plate (4), the second fluid inlet and outlet manifolds (20, 22) portion close to the peripheral edge portion (38) of the heat exchanger plate (4) can be cooled and can help to reduce the thermal stress, particularly, on the second fluid inlet manifold (20). In addition, this can help to limit the amount of hot exhaust gas that contacts the peripheral edge portion (38) of the heat exchanger plates (4), thereby reducing the thermal stress on the edges (58) of the heat exchanger plates (4).

Typically and as can be seen in FIG. 5, there can be significant heat transmission from the valve body (68) to the mounting plate (70) of the heat exchanger (2), even when the flow of the hot exhaust gas bypasses the heat exchanger (2). Generally, the mounting plate (70) will be coupled to the valve (68) using mechanical means, for example and without limitation, by bolts. Such a structural set-up can also lead to thermal stress on the mounting plate (70) of the heat exchanger (2).

Figure 6:
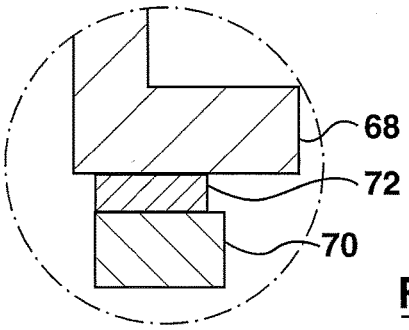
FIG. 6 shows an expanded portion of the area connecting the heat exchanger to a valve body.

In one aspect, a thermally insulating gasket (72) is provided between the exhaust gas valve body (68) and the heat exchanger mounting plate (70) as shown in FIG. 6; which shows a partial, close-up view of the connection between the valve body (68) and the heat exchanger (2). This can help to reduce unintended heat transfer to the coolant when in heat exchanger bypass mode; and, as should be appreciated by those of skill in the art, can further help to reduce the thermal stress on the heat exchanger (2), including the connection between the valve (68) and the heat exchanger (2).

In accordance with a further aspect, the specification discloses a deflector plate (6) (see FIGS. 7-9) having a passage (40) permitting fluid communication from a first fluid inlet (42) to a first fluid outlet (44). The passage (40), first fluid inlet (42) and first fluid outlet (44) of the deflector plate (6) can be similar to the passage (32), first fluid inlet (16) and first fluid outlet (18) of the heat exchanger plate (4), described herein. In addition, the features of the deflector plate (6) can be made to cooperate with the heat exchanger plate (4); and in one embodiment as disclosed herein, are similar to the features of the heat exchanger plate (4).

Figure 1:
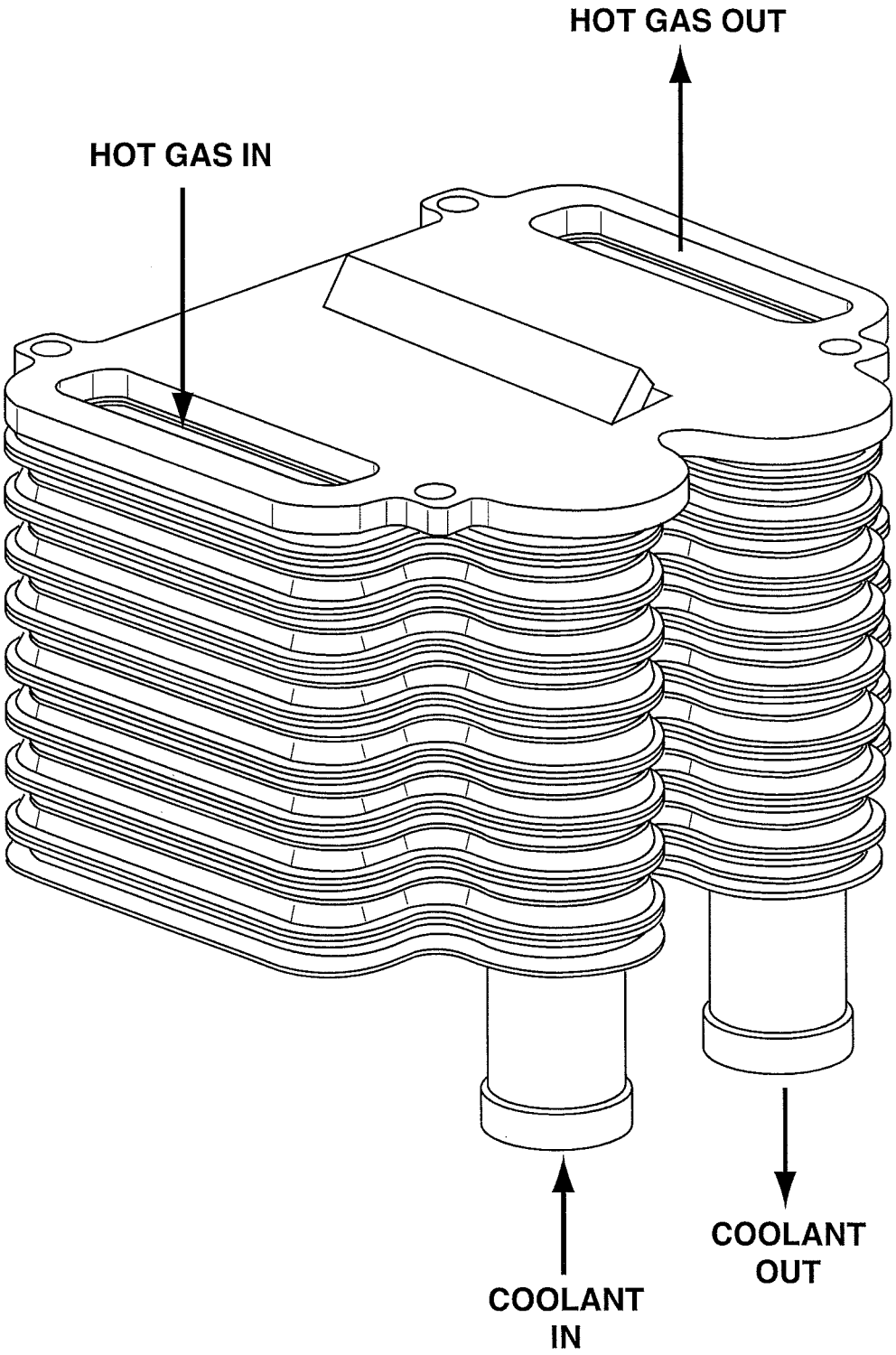
FIG. 1 shows an exhaust gas heat recovery (EGHR) heat exchanger.
Figure 2:
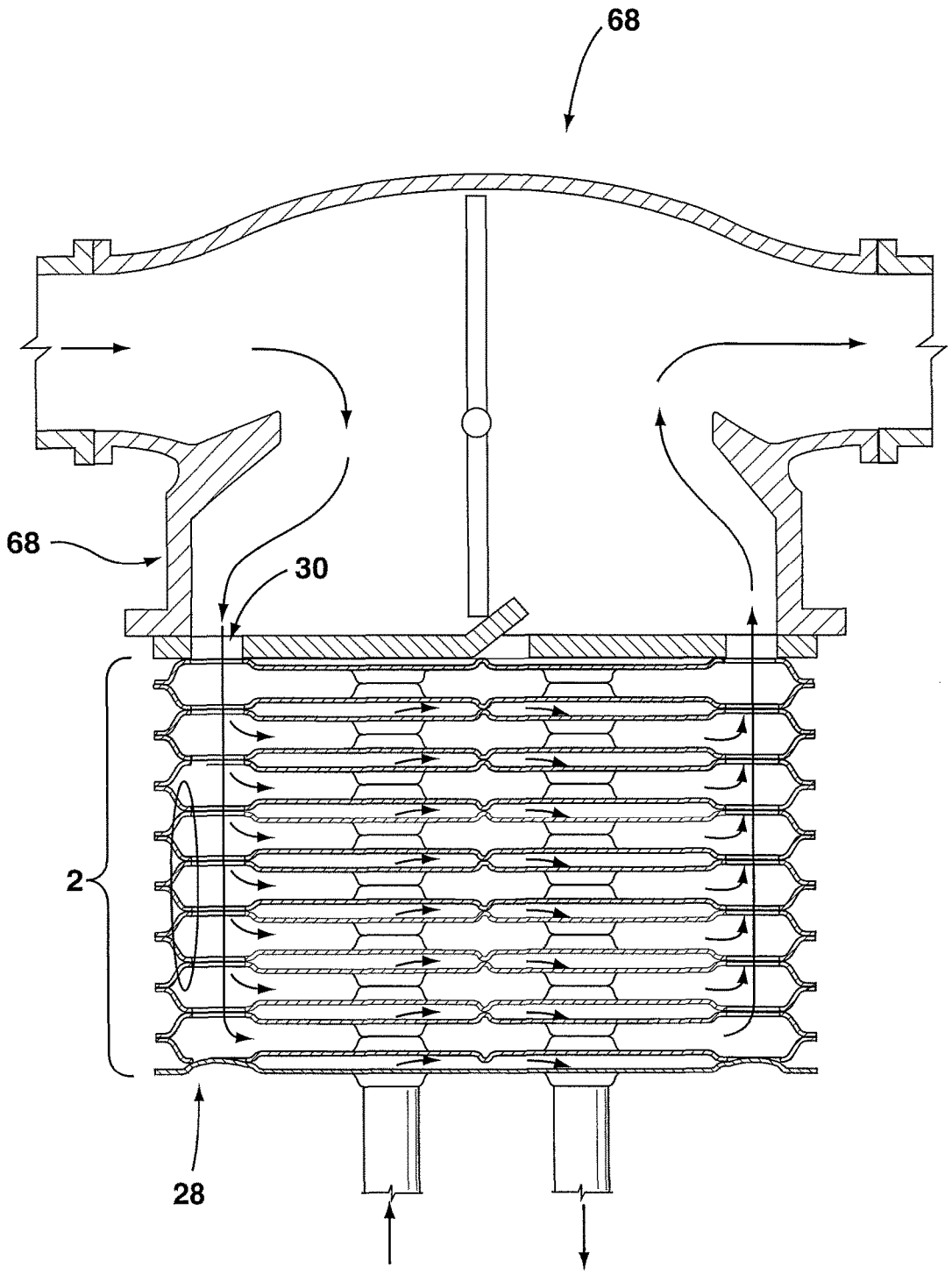
FIG. 2 shows a heat exchanger mounted to an exhaust valve.
Figure 3:
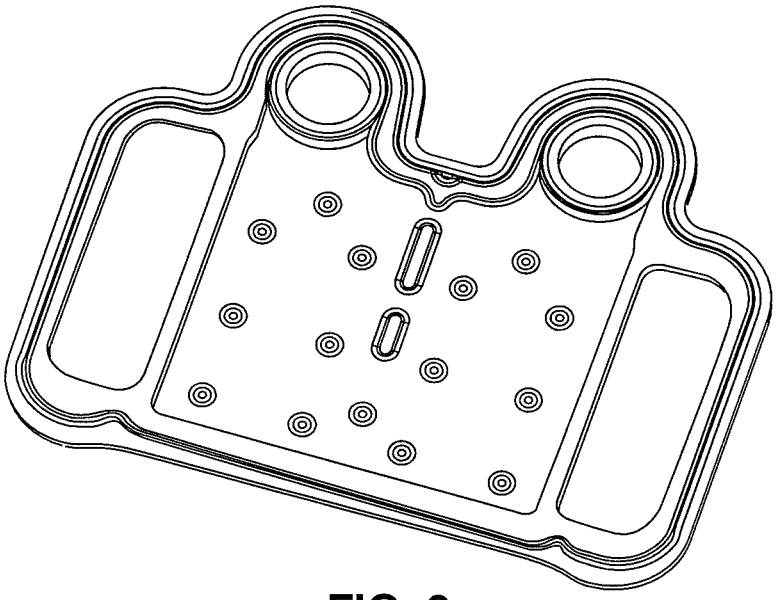
FIG. 3 shows a heat exchanger plate of a heat exchanger shown in FIG. 2.

Similar to the heat exchanger plate (4), the deflector plate (6) is provided with a peripheral edge portion (46) that is adapted for operatively coupling of the deflector plate (6) to a second plate, such as a heat exchanger plate (4) or base plate (74). The base plate (74) can be similar to the base plate of a heat exchanger apparatus as shown in FIG. 2. In one embodiment, as shown in FIG. 5, coupling of the deflector plate (6) with the base plate (74) helps to form a first fluid conduit (8) that permits fluid flow from the first fluid inlet (42) to the first fluid outlet (44) of the deflector plate (6) via the deflector plate passage (40).

In one embodiment, as disclosed herein, the deflector plate (6) is positioned near an end of the heat exchanger (2), which is distal from the opening (30) where the hot exhaust gas enters. In the embodiment shown in FIG. 5, the deflector plate (6) is positioned between the heat exchanger plate (4) and the base plate (74). In one embodiment, the deflector plate (6) can be formed to allow the embossment (34) of the deflector plate (6) to contact the base plate (74) to form an end of the second fluid inlet (20) and outlet (22) manifolds. Further, the peripheral flange (60) of the deflector plate (6) can contact the peripheral flange (60) of an adjacent heat exchanger plate (4) to form the second fluid conduit (10).

Figure 7:
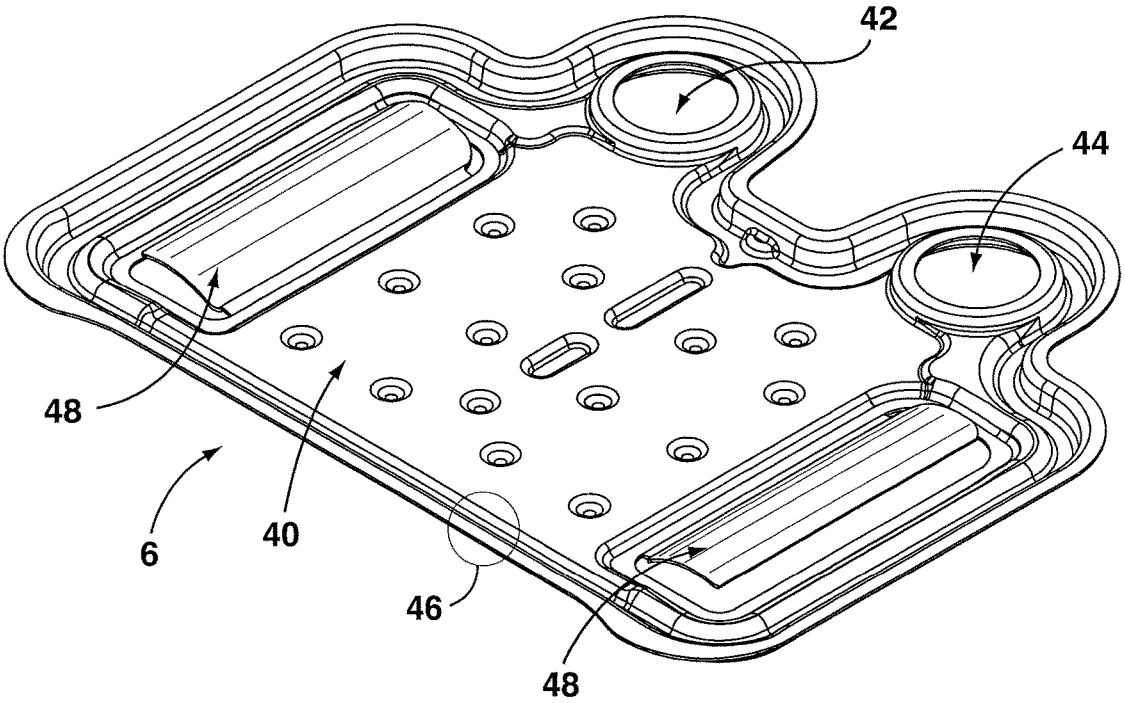
FIG. 7 shows a perspective view of a deflector plate in accordance with an embodiment of the specification.
Figure 8:
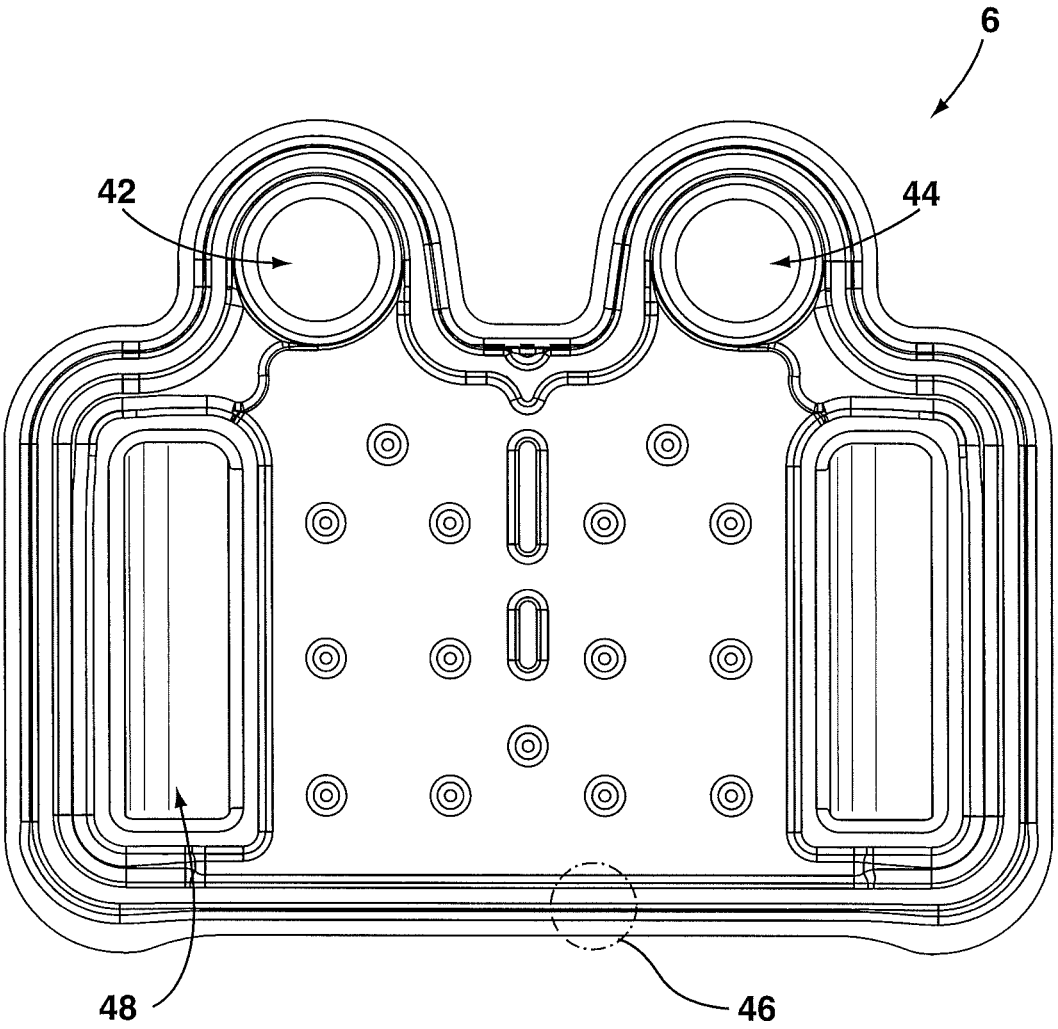
FIG. 8 shows a plan view of a deflector plate in accordance with an embodiment of the specification.
Figure 9:
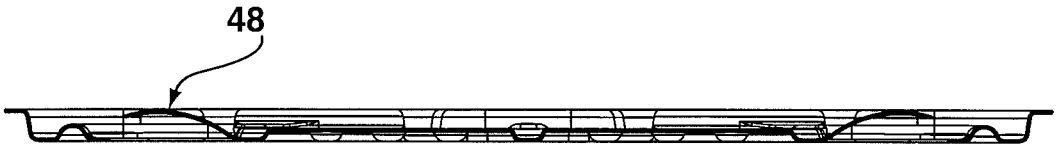
FIG. 9 shows a cross-sectional view of a deflector plate in accordance with an embodiment of the specification.

In a further embodiment in accordance with the specification and as disclosed in FIGS. 7-9, a deflector (48) is coupled to the deflector plate (6) for shielding the base plate (74) from hot exhaust gas that passes along the second fluid inlet manifold (20). As a significant portion of the hot exhaust gas flows from the opening (30) in the valve (68) to the deflector plate (6) or base plate (74), the base plate (74) area where the second fluid inlet manifold (20) ends can become significantly hotter than other areas, and consequently, can encounter significantly higher thermal stress or material degradation. By placing a deflector (48) that engages the second fluid inlet (24) of an adjacent heat exchanger plate (4), the hot exhaust gas is prevented from directly impinging on the base plate (74) where the second fluid inlet manifold (20) ends. Consequently, the deflector (48) can help to reduce the thermal stress placed on the base plate (74). Moreover, the deflector plate (6) is itself in thermal contact with coolant channels (8) and (50), to further reduce thermal loads on the base plate.

The position of the deflector (48) is aligned with the second fluid inlet manifold (20) to shield the base plate (74) from the hot exhaust gas. In addition, as shown in the figures, the deflector (48) extends in the same direction as the bosses having the first fluid inlet and outlet (42, 44). In one embodiment, the size and position of the deflector (48) allows the deflector to protrude towards the second fluid inlet (24) or outlet (26) of an adjacent heat exchanger plate (4). The size and shape of the deflector (48) is not particularly limited. In one embodiment, for example and without limitation, the deflector (48) is sized to nearly fill the entire area of the second fluid inlet (24) or outlet (26) of an adjacent heat exchanger plate (4). In another embodiment, in accordance with the specification, the deflector (48) has an arcuate shape as shown in the figures, with the convex portion of the deflector (48) facing the hot exhaust gas.

The point of coupling of the deflector (48) to the deflector plate (6) and the means for coupling the deflector (48) to the deflector plate (6) are also not particularly limited. In one embodiment, as shown in FIGS. 5 and 7-9, the deflector (48) is coupled to the deflector plate (6) near the deflector plate passage (40) rather than near the peripheral edge portion (46) of the deflector plate (6). In a further embodiment, the means for coupling the deflector (48) to the deflector plate (6) can vary depending upon the particular product requirements. In one embodiment, for example and without limitation, the deflector (48) is an integral part of the deflector plate (6), permitting for example the deflector to be integrally formed during the stamping of the deflector plate (6).

The material of construction of the deflector (48) and the number of deflectors (48) in the deflector plate (6) are also not particularly limited. In one embodiment, for example and without limitation, the material of construction of the deflector (48) is the same as that used for the making the deflector plate (6), particularly when the deflector (48) is an integral part of the deflector plate (6). In a particular embodiment and as shown in the figures, two deflectors (48) can be provided on the deflector plate (6). One of the deflectors (48) is aligned with the second fluid inlet manifold (20), while the second is aligned with the second fluid outlet manifold (22). Such an embodiment can help with protection of the base plate (74) from the hot exhaust gas, entering from the second fluid inlet (24) and preventing direct impingement on the base plate (74). While the second deflector (48) can help guide the hot fluid gases towards the second fluid outlet manifold (22), thereby also protecting the base plate (74) and the peripheral edge portion (38). An alternate embodiment having only a single deflector (48) positioned in line with the second fluid inlet manifold (20) are also possible, which could provide protection of the base plate (74) from the hot exhaust gas and prevent direct impingement on the base plate (74).

The presence of deflector (48) can have significant advantages in addition to the protection provided to the base plate (74). The deflector (48) can narrow the entrance of the second fluid inlet (24) to the second fluid conduit (10) closest to the deflector plate (6), thereby reducing the quantity of hot exhaust gas contacting the base plate (74). This can help to reduce the thermal stress on the base plate (74). In addition, the partial blocking of the second fluid inlet (24) to the second fluid conduit (10) closest to the deflector plate (6) can help to improve the heat flow distribution of the hot exhaust gas to the other second fluid conduits (10) in the heat exchanger. This can result in improved heat exchange efficiency between the hot exhaust gas and the coolant.

In a further embodiment, the deflector plate (6) has a depression (not shown) that is similar to the depression (64) in a base plate (74), and is positioned underneath the deflectors (48). Such an embodiment can be formed by providing a continuous plate surface from one edge of the embossment (34) to the opposing edge. In other words, the deflector plate (6) can lack the openings in the embossments (34) that can provide a passage for flow of the second fluid. In addition, the deflector plate (6) is provided with a deflector (48) that extends above such a depression. The position and presence of the depression can help to stiffen and/or further strengthen the deflector plate (6), as the deflector plate (6) is typically of the same thickness as all other plates in the stack.

Figure 10:
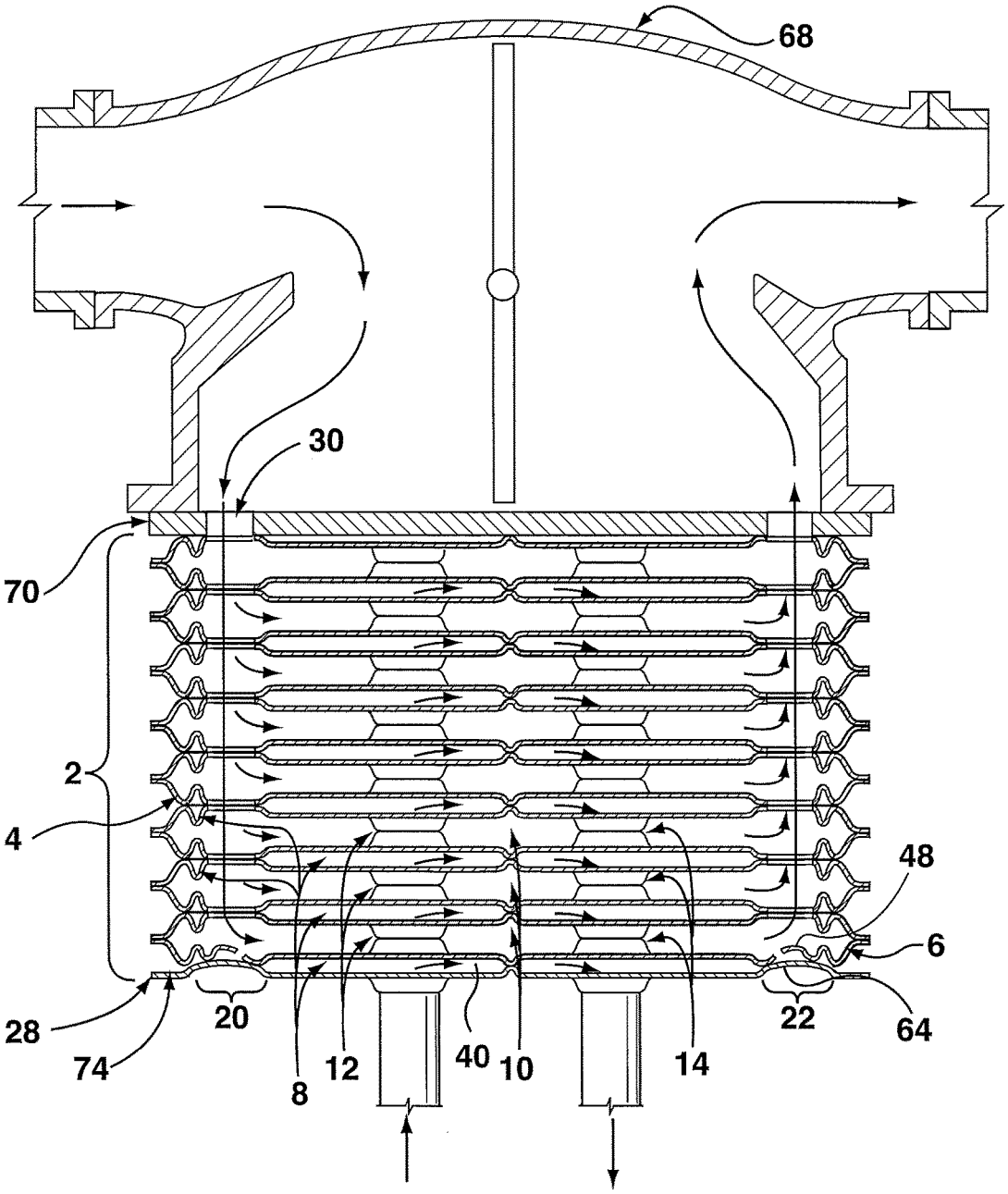
FIG. 10 shows in accordance with another embodiment of the specification a heat exchanger mounted to an exhaust valve.
Figure 11:
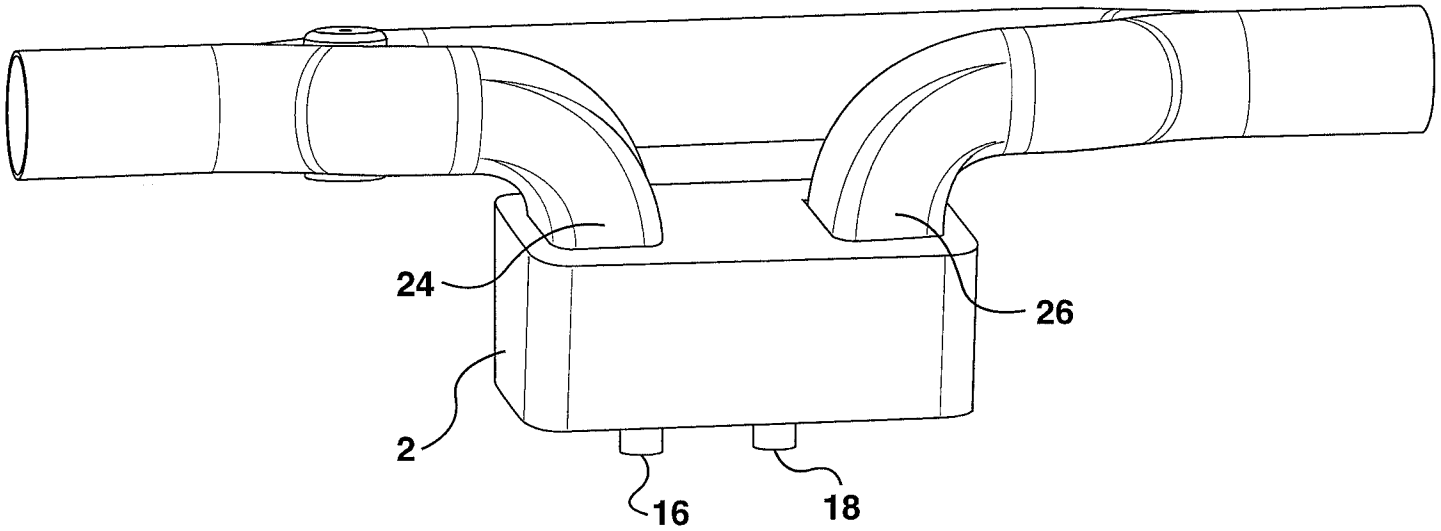
FIG. 11 shows in accordance with a further embodiment of the specification a heat exchanger mounted to a valve.

FIGS. 10 and 11 show alternate embodiments of a heat exchanger apparatus (2) in accordance with the invention disclosed herein. FIG. 10 discloses a heat exchanger apparatus (2) that is similar to the heat exchanger apparatus (2) disclosed in FIG. 5, with some differences. In the embodiment shown in FIG. 10, the top heat exchanger plate (4) coupled to the mounting plate (70) is similar to the other heat exchanger plates (4), while in FIG. 5, the heat exchanger plate (4) coupled to the mounting plate (70) can be flat.

In addition to the above, FIG. 10 discloses an alternate embodiment of the deflector plate (6) in accordance with the invention disclosed herein. In contrast to the deflector plate (6) disclosed in FIG. 5, where the deflector extends from the edge of the embossment (34) close to the passage (40) to the peripheral edge portion (46), in the embodiment disclosed in FIG. 10, the deflector extends from the edge of the embossment (34) close to the peripheral edge portion (46) towards the passage (40).

FIG. 11 discloses a further embodiment of the heat exchanger apparatus (2) disclosed herein. In the embodiment disclosed, the heat exchanger apparatus (2) is not mounted to a mounting plate (70) as shown in FIGS. 5 and 10, but rather is attached to inlet and outlet ducts that communicate with the second fluid inlet and outlet manifolds (20, 22). Therefore, in accordance with a further embodiment disclosed herein, the heat exchanger apparatus (2) can be mounted to a mounting plate (70) of a valve or inlet and outlet ducts can be coupled to a manifold of the heat exchanger apparatus (2).

Figure 12:
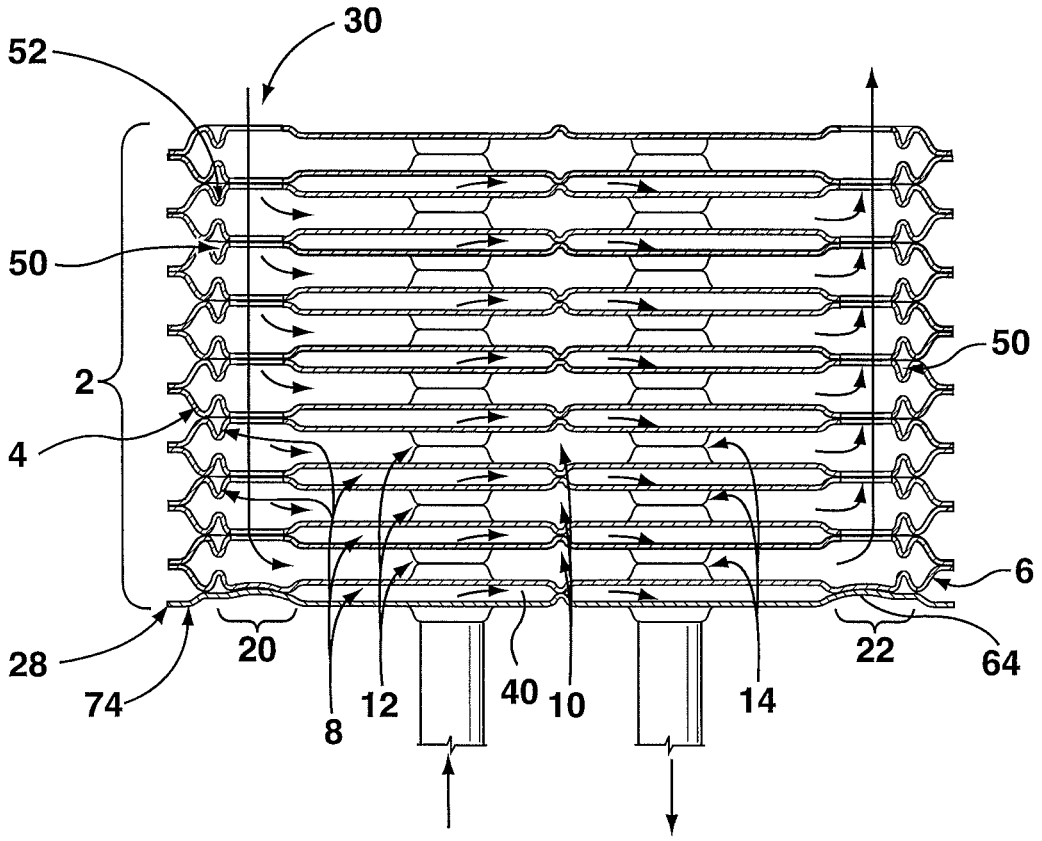
FIG. 12 shows in accordance with another further embodiment of the specification a heat exchanger having manifold cooling.

FIG. 12 discloses another further embodiment of a heat exchanger (2). The heat exchanger (2) can be provided as a stand alone unit or attached to source, such as a valve, providing the second fluid that flows along the second fluid inlet and outlet manifolds (20, 22). In the embodiment disclosed in FIG. 12, the heat exchanger (2) is composed of heat exchanger plate (4) having manifold cooling, as disclosed herein.

Figure 13:
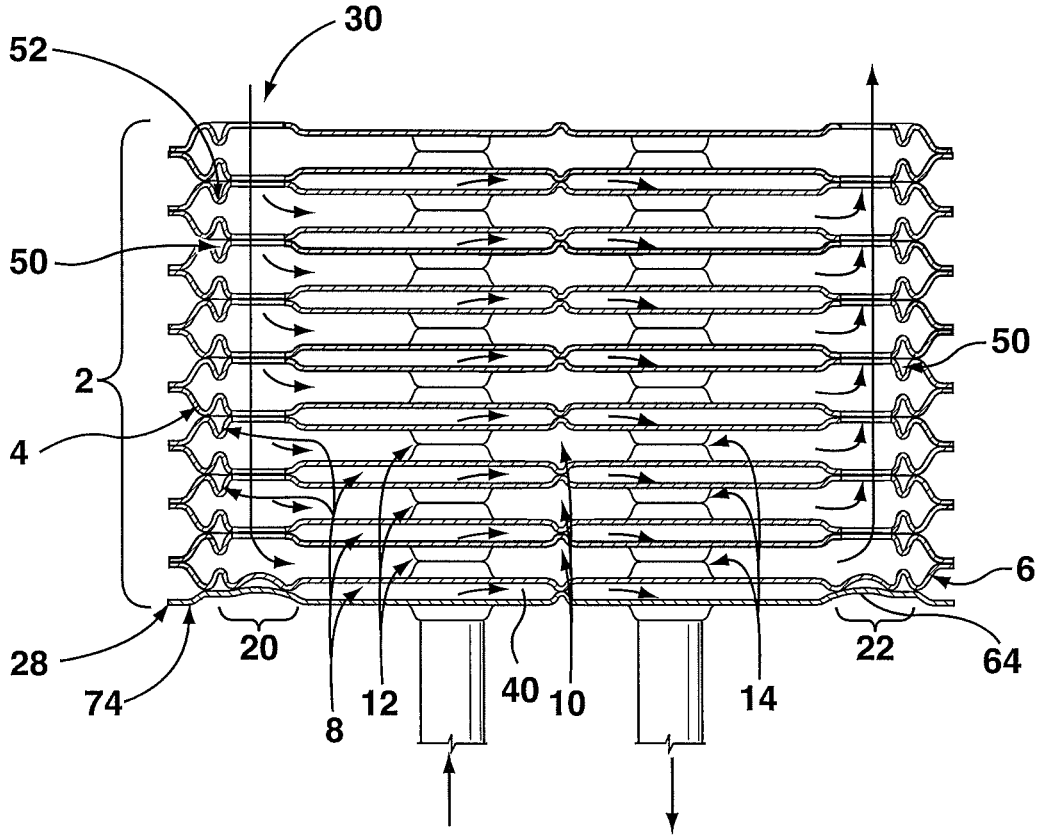
FIG. 13 shows in accordance with another embodiment of the specification a heat exchanger having manifold cooling.

In addition, in FIG. 12, the deflector plate (6) also has manifold cooling, by use of channels (50) positioned between the peripheral edge portion (38) and the second fluid inlet and outlet manifolds (20, 22). Moreover, the deflector (48) formed in the embodiment shown in FIG. 12, extends from one edge of the embossment (34) of the second fluid inlet or outlet to an opposing edge of the embossment (34) of the same second fluid inlet or outlet. Although, the deflector (48) shown in FIG. 12 is continuous and in contact with the base plate (74), the deflector (48) can be arcuate and spaced from the base plate (74), as shown in FIGS. 5, 11 and 13, while also extending from one edge of an embossment (34) to an opposing edge. The deflector (48) can also be in contact with all the edges of the embossment (34). Consequently, the base plate (74) is shielded from the hot exhaust fluid flowing through the second fluid inlet and outlet manifolds (20, 22).

Figure 14:
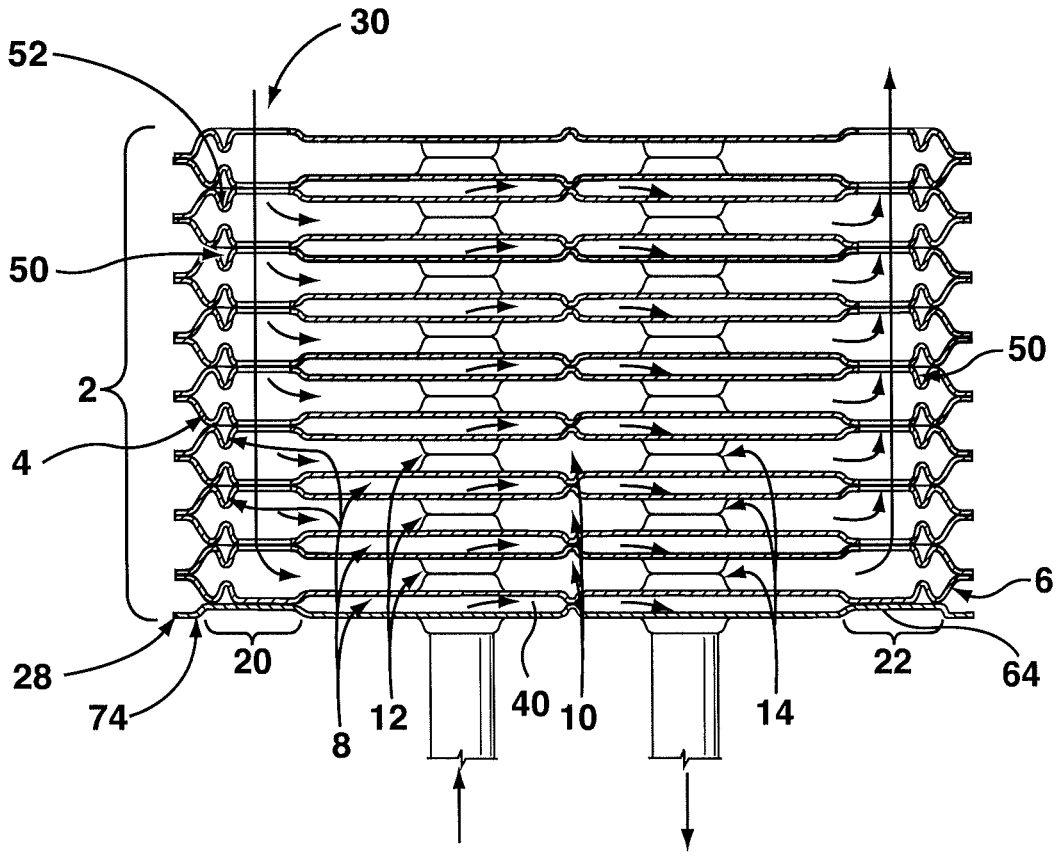
FIG. 14 shows in accordance with still another embodiment of the specification a heat exchanger having manifold cooling.

FIG. 14 shows a further embodiment of a heat exchanger apparatus (2). In the embodiment shown in FIG. 14, the base plate (74) is formed by a flat plate having an embossment, instead of the depression (64); with the embossment lining up with the second fluid inlet and outlets (16, 18) of the heat exchanger plates (4). In addition, the deflector plate (6) (positioned adjacent to the base plate (74) in the embodiment shown) has the peripheral wall (56) of the peripheral edge portion (46) in contact with the embossment of the base plate (74), with the channel (50) positioned over the embossment of the base plate (74).

As shown in FIG. 14, the embossment (34) of the deflector plate (6), which in the embodiment shown is formed by a solid plate portion is in contact with the embossment of the base plate (74). By providing a solid flat portion, the deflector plate (6) can help to shield, protect, block or prevent contact of the hot exhaust gases with the base plate (74). The deflector plate (6) shown in FIG. 14 is similar to the heat exchanger plate (4) disclosed herein and also as shown in FIG. 14. The difference between the deflector plate (6) and the heat exchanger plate (4) lies in the absence of an aperture in the embossment. Consequently, the deflector plate (6) is like the heat exchanger plate (4) shown in FIG. 14 but lacks the second fluid inlet and outlet, and provides a solid surface for preventing direct impingement of the hot exhaust gases onto the base plate (74).

Embodiments

Embodiments of the invention are disclosed herein, which include, for example and without limitation, the following.

1. A heat exchanger plate containing:

a passage permitting fluid communication from a heat exchanger plate first fluid inlet to a heat exchanger plate first fluid outlet;

a pair of bosses, with one of the bosses having the first fluid inlet and the second boss having the first fluid outlet;

a pair of embossments, the embossments being positioned for engaging an embossment in an adjacent heat exchanger plate, when a plurality of heat exchanger plates are stacked;

a peripheral edge portion adapted for operatively coupling of the heat exchanger plate to a second plate, and wherein a plurality of face-to-face stacked heat exchanger plates form a first fluid conduit for flow of a first fluid from a heat exchanger first fluid inlet to a heat exchanger first fluid outlet; and a channel positioned intermediate the peripheral edge portion and the embossment, and permitting fluid communication from the heat exchanger plate first fluid inlet to the passage.

2. The heat exchanger plate according to embodiment 1, wherein each embossment has an aperture permitting flow of a second fluid; and wherein a plurality of face-to-face stacked heat exchanger plates forms a second fluid conduit for flow of the second fluid from a heat exchanger second fluid inlet to a heat exchanger second fluid outlet.

3. The heat exchanger plate according to embodiment 1 or 2, wherein the channel has a bed being in a plane different from a plane defined by the passage for facilitating preferential flow of a first fluid from the heat exchanger plate first fluid inlet to the channel over flow to the passage.

4. The heat exchanger plate according to any one of embodiments 1 to 3, further containing:

an indentation from the channel to the boss having the first fluid inlet;

wherein the bed is in a plane between the plane of the passage and the plane of the boss having first fluid inlet.

5. The heat exchanger plate according to embodiment 4, further containing a step from the channel to the passage of the heat exchanger plate, the step being positioned proximate to an opposing end from the first heat exchanger inlet and outlet, and also between the peripheral edge portion and the embossments permitting second fluid flow.

6. The heat exchanger plate according to any one of embodiments 1 to 5, further containing a second channel positioned intermediate the peripheral edge portion and the embossment, and permitting fluid communication from the passage to the heat exchanger plate first fluid outlet; the channel having a bed being in a plane different from a plane defined by the passage for facilitating preferential flow of a first fluid from the passage to the second channel.

7. The heat exchanger plate according to embodiment 6, further containing a second step from the passage to the second channel of the heat exchanger plate, the second step being positioned proximate to an opposing end from the first heat exchanger inlet and outlet, and also between the peripheral edge portion and the embossments permitting second fluid flow.

8. The heat exchanger plate according to any one of embodiments 1 to 7, wherein the peripheral edge portion contains a peripheral wall and a peripheral flange extending from the wall to a peripheral edge.

9. The heat exchanger plate according to any one of embodiments 1 to 8, wherein the passage contains protrusions or dimples.

10. A heat exchanger apparatus containing:

a plurality of heat exchanger plates, the heat exchanger plates being placed in a face-to-face relationship and defining a first fluid conduit and a second fluid conduit, first fluid inlet and outlet manifolds having a first fluid inlet and first fluid outlet, respectively, and in fluid communication with the first fluid conduit, and a second fluid inlet and outlet manifolds having a second fluid inlet and a second fluid outlet, respectively, and being in fluid communication with the second fluid conduit, the plurality of heat exchanger plates permitting heat exchange between first and second fluids in the first and second fluid conduits, respectively, and wherein each of the plurality of heat exchanger plates containing:

a passage permitting fluid communication from a heat exchanger plate first fluid inlet to a heat exchanger plate first fluid outlet;

a pair of bosses, with one of the bosses having the first fluid inlet and the second boss having the first fluid outlet;

a pair of embossments, each embossment having an aperture permitting flow of a second fluid;

a peripheral edge portion adapted for operatively coupling of the heat exchanger plate to a second plate; and a channel positioned intermediate the peripheral edge portion and the embossment, and permitting fluid communication from the heat exchanger plate first fluid inlet to the passage.

11. The heat exchanger apparatus according to embodiment 10, wherein the channel has a bed being in a plane different from a plane defined by the passage for facilitating preferential flow of a first fluid from the heat exchanger plate first fluid inlet to the channel over flow to the passage.

12. The heat exchanger apparatus of embodiment 10 or 11, further containing a deflector plate and a base plate, the deflector plate and the base plate being positioned distil from the second fluid inlet, and the deflector plate containing:

a deflector plate passage permitting fluid communication from a deflector plate first fluid inlet to a deflector plate first fluid outlet; the deflector plate first fluid inlet and outlet being in fluid communication with the heat exchanger plate inlet and outlet, respectively;

a pair of deflector plate bosses, with one of the bosses having a deflector plate first fluid inlet and the second boss having a deflector plate first fluid outlet;

a pair of deflector plate embossments, the embossments being positioned for engaging the base plate, and preventing contact of the second fluid from the base plate;

a deflector plate peripheral edge portion adapted for operatively coupling of the deflector plate to the base plate; and a deflector plate channel positioned intermediate the deflector plate peripheral edge portion and the deflector plate embossment, and permitting fluid communication from the deflector plate first fluid inlet to the deflector plate passage.

13. The heat exchanger apparatus according to any one of embodiments 10 to 12, wherein the heat exchanger plate further contains:

an indentation from the channel to the boss having the first fluid inlet;

wherein the bed is in a plane between the plane of the passage and the plane of the boss having first fluid inlet.

14. The heat exchanger apparatus according to embodiment 13, wherein the heat exchanger plate further contains a step from the channel to the passage of the heat exchanger plate, the step being positioned proximate to an opposing end from the first heat exchanger inlet and outlet, and also between the peripheral edge portion and the embossments permitting second fluid flow.

15. The heat exchanger apparatus according to any one of embodiments 10 to 14, wherein the heat exchanger plate further contains a second channel positioned intermediate the peripheral edge portion and the embossment, and permitting fluid communication from the passage to the heat exchanger plate first fluid outlet; the channel having a bed being in a plane different from a plane defined by the passage for facilitating preferential flow of a first fluid from the passage to the second channel.

16. The heat exchanger apparatus according to embodiment 15, wherein the heat exchanger plate further contains a second step from the passage to the second channel of the heat exchanger plate, the second step being positioned proximate to an opposing end from the first heat exchanger inlet and outlet, and also between the peripheral edge portion and the embossments permitting second fluid flow.

17. The heat exchanger apparatus according to any one of embodiments 10 to 16, wherein the peripheral edge portion contains a peripheral wall and a peripheral flange extending from the wall to a peripheral edge.

18. The heat exchanger apparatus according to any one of embodiments 10 to 17, wherein the passage contains protrusions or dimples.

19. The heat exchanger apparatus according to any one of embodiments 10 to 18, wherein the apparatus is coupled to a valve.

20. The heat exchanger apparatus according to embodiment 19, further containing a gasket positioned between the valve and the heat apparatus.

21. A deflector plate containing:

a first boss and a second boss, both extending in a first direction from a plane of a passage, the first boss having a deflector plate first fluid inlet and the second boss having a deflector plate first fluid outlet, and the passage permitting flow of a first fluid from the deflector plate first fluid inlet to the deflector plate first fluid outlet;

a peripheral edge portion adapted for operatively coupling of the deflector plate to a second plate, and wherein a plurality of face-to-face stacked plates form a first fluid conduit for flow of the first fluid from a first fluid inlet to a first fluid outlet and a second fluid conduit for flow of a second fluid from a second fluid inlet to a second fluid outlet; and an embossment extending in a second direction, the second direction being opposed to the first direction, and the peripheral edge of the embossment being positioned for alignment with a peripheral edge of the second fluid conduit upon stacking of the plates; and a deflector extending from the embossment in the first direction.

22. The deflector plate according to embodiment 21, wherein the deflector has an arcuate profile and extends into the second fluid conduit upon stacking of the plates.

23. The deflector plate according to embodiment 21 or 22, wherein the deflector is coupled to the edge of the embossment and extends from proximate to the passage to the peripheral edge.

24. The deflector plate according to embodiment 21 or 22, wherein the deflector is coupled to the edge of the embossment and extends from proximate to the peripheral edge to the passage.

25. The deflector plate according to any one of embodiments 21 to 24, further containing a channel positioned intermediate the peripheral edge portion and the embossment, and permitting fluid communication from the deflector plate first fluid inlet to the passage; the channel having a bed being in a plane different from a plane defined by the passage for facilitating preferential flow of the first fluid from the deflector plate first fluid inlet to the channel over flow to the passage.

26. The deflector plate according to any one of embodiments 21 to 25, further containing an indentation from the channel to the boss having the first fluid inlet; and wherein the bed is in a plane between the plane of the passage and the plane of the boss having first fluid inlet.

27. The deflector plate according to any one of embodiments 21 to 26, further containing a step from the channel to the passage of the deflector plate, the step being positioned proximate to an opposing end from the deflector plate first fluid inlet and outlet, and also between the peripheral edge portion and the embossments.

28. The deflector plate according to any one of embodiments 21 to 27, further containing a second channel positioned intermediate the peripheral edge portion and the embossment, and permitting fluid communication from the passage to the deflector plate first fluid outlet; the channel having a bed being in a plane different from a plane defined by the passage for facilitating preferential flow of a first fluid from the passage to the second channel.

29. The deflector plate according to embodiment 28, further containing a second step from the passage to the second channel of the deflector plate, the second step being positioned proximate to an opposing end from the deflector plate inlet and outlet, and also between the peripheral edge portion and the embossments.

30. The deflector plate according to any one of embodiments 21 to 29, wherein the peripheral edge portion contains a peripheral wall and a peripheral flange extending from the wall to a peripheral edge.

31. The deflector plate according to any one of embodiments 21 to 30, wherein the passage contains protrusions or dimples.

32. A heat exchanger apparatus containing:

a plurality of heat exchanger plates and a deflector plate coupled to one another, the plurality of heat exchanger plates together with the deflector plate defining first and second fluid conduits permitting heat exchange between first and second fluids flowing in the first and second fluid conduits, respectively;

a first fluid inlet and outlet manifolds coupled to the plurality of heat exchanger plates and deflector plate for flow of the first fluid from a first fluid inlet to a first fluid outlet via the first fluid conduit;

a second fluid inlet and outlet manifolds coupled to the plurality of heat exchanger plates and deflector plate for flow of the second fluid from a second fluid inlet to a second fluid outlet via the second fluid conduit; and a deflector coupled to the deflector plate for shielding the base plate from the second fluid, wherein the deflector plate is positioned distal from an opening permitting entry of the second fluid flow in the second fluid inlet manifold.

33. The heat exchanger apparatus according to embodiment 32, wherein the deflector plate contains:

a first boss and a second boss, both extending in a first direction from a plane of a passage, the first boss having a deflector plate first fluid inlet and the second boss having a deflector plate first fluid outlet, and the passage permitting flow of a first fluid from the deflector plate first fluid inlet to the deflector plate first fluid outlet;

a peripheral edge portion adapted for operatively coupling of the deflector plate to the heat exchanger plate; and an embossment extending in a second direction, the second direction being opposed to the first direction, and the peripheral edge of the embossment being positioned for alignment with a peripheral edge of the second fluid conduit upon stacking of the plates; and the deflector extending from the embossment in the first direction.

34. The heat exchanger according to embodiment 33, wherein the deflector has an arcuate profile and extends into the second fluid conduit upon stacking of the plates.

35. The heat exchanger according to embodiment 33 or 34, wherein the deflector is coupled to the edge of the embossment and extends from proximate to the passage to the peripheral edge.

36. The heat exchanger according to embodiment 33 or 34, wherein the deflector is coupled to the edge of the embossment and extends from proximate to the peripheral edge to the passage.

37. The heat exchanger according to any one of embodiments 33 to 36, further containing a channel positioned intermediate the peripheral edge portion and the embossment, and permitting fluid communication from the first fluid inlet to the passage; the channel having a bed being in a plane different from a plane defined by the passage for facilitating preferential flow of the first fluid from the first fluid inlet to the channel over flow to the passage.

38. The heat exchanger according to any one of embodiments 33 to 37, further containing an indentation from the channel to the boss having the first fluid inlet; and wherein the bed is in a plane between the plane of the passage and the plane of the boss having first fluid inlet.

39. The heat exchanger according to any one of embodiments 33 to 38, further containing a step from the channel to the passage, the step being positioned proximate to an opposing end from the first fluid inlet and outlet, and also between the peripheral edge portion and the embossments.

40. The heat exchanger according to any one of embodiments 33 to 39, further containing a second channel positioned intermediate the peripheral edge portion and the embossment, and permitting fluid communication from the passage to the first fluid outlet; the channel having a bed being in a plane different from a plane defined by the passage for facilitating preferential flow of a first fluid from the passage to the second channel.

41. The heat exchanger according to embodiment 40, further containing a second step from the passage to the second channel, the second step being positioned proximate to an opposing end from the first fluid inlet and outlet, and also between the peripheral edge portion and the embossments.

42. The heat exchanger according to any one of embodiments 33 to 41, wherein the peripheral edge portion contains a peripheral wall and a peripheral flange extending from the wall to a peripheral edge.

43. The heat exchanger according to any one of embodiments 33 to 42, wherein the passage contains protrusions or dimples.

Certain adaptations and modifications of the described embodiments can be made. Therefore, the above discussed embodiments are considered to be illustrative and not restrictive.

PARTS LIST

| | |
|---|---|
| 2 | heat exchanger apparatus passage |
| 4 | heat exchanger (HX) plate |
| 6 | deflector plate outlet |
| 8 | first fluid conduit portion |
| 10 | second fluid conduit |
| 12 | first fluid inlet manifold |
| 14 | first fluid outlet manifold |
| 16 | first fluid inlet |
| 18 | first fluid outlet |
| 20 | second fluid inlet manifold |
| 22 | second fluid outlet manifold |
| 24 | second fluid inlet |
| 26 | second fluid outlet |
| 28 | distal end of HX plates |
| 30 | opening for of $2^{nd}$ fluid flow entry |
| 32 | HX plate passage |
| 34 | embossment gasket |
| 36 | aperture |
| 38 | HX plate peripheral edge portion |
| 40 | deflector (DF) plate |
| 42 | deflector first fluid inlet |
| 44 | deflector first fluid |
| 46 | DF peripheral edge |
| 48 | deflector |
| 50 | channel |
| 52 | bed |
| 54 | bosses |
| 56 | peripheral wall |
| 58 | peripheral edge |
| 60 | peripheral flange |
| 62 | indentation |
| 64 | depression |
| 66 | step |
| 68 | valve |
| 70 | mounting plate |
| 72 | thermally insulating |

-continued

| | |
|---|---|
| 74 | base plate |
| 76 | dimple |

What is claimed is:

1. A heat exchanger plate comprising:

a first hole defining a first fluid inlet, a second hole defining a first fluid outlet, a third hole defining a second fluid inlet, and a fourth hole defining a second fluid outlet;

a central planar portion including a first planar surface located on a first side of the plate and defining a plane, a second planar surface located on a second side of the plate and defining a plane, the first surface facing a first direction, and the second surface facing a second direction which is opposite the first direction;

a plurality of bosses, each of the bosses comprising a planar portion, the planar portion having a first planar surface and a second planar surface, the first planar surface located on the first side of the plate and defining a plane, the second planar surface located on the second side of the plate and defining a plane;

wherein the plurality of bosses includes a pair of first bosses, each of the first bosses extending from the central planar portion such that the planes of the first bosses are spaced in the first direction from the planes of the central planar portion, wherein the first hole is provided through the planar portion of one of the first bosses, and the second hole is provided through the planar portion of the other first boss;

wherein the plurality of bosses includes a pair of second bosses, each of the second bosses extending from the central planar portion such that the planes of the second bosses are spaced in the second direction from the planes of the central planar portion, wherein the third hole is provided through the planar portion of one of the second bosses, and the second hole is provided through the planar portion of the other first boss;

wherein the plurality of bosses includes a pair of third bosses, each of the third bosses extending from the central planar portion, one of the first bosses, and one of the second bosses such that the planes of the third bosses are spaced in the first direction from the planes of the central planar portion and in the second direction from the planes of the first bosses;

wherein the plurality of bosses includes a fourth boss, the fourth boss surrounding the pair of first bosses, the pair of second bosses, and the pair of third bosses, and wherein the planes of the fourth boss are substantially the same as the planes of the second bosses;

wherein each of the third bosses defines a channel on the second side of the plate between one of the second bosses and the fourth boss; and wherein the plurality of bosses includes a fifth boss, the fifth boss surrounding the fourth boss, and wherein the planes of the fifth boss are substantially the same as the planes of the first bosses.

2. The heat exchanger plate according to claim 1, wherein each of the third bosses extends from the central planar portion to define a step, the steps being located at an end of the plate opposite from the first and second holes.

3. The heat exchanger plate according to claim 1, further comprising dimples or ribs on the central planar portion.

4. The heat exchanger plate according to claim 3, wherein the dimples or ribs permit a U-shaped flow path of the first fluid from the first fluid inlet to the first fluid outlet.

5. A heat exchanger apparatus comprising:

a heat exchanger plate stack, the plate stack comprising a plurality of heat exchanger plates connected together, wherein each of the heat exchanger plates is the heat exchanger plate according to claim 1.

6. The heat exchanger apparatus of claim 5, further comprising a deflector plate and a base plate, wherein the deflector plate is connected to an end of the plate stack, and the base plate is connected to the deflector plate.

7. The heat exchanger apparatus of claim 5, further comprising a valve coupled to the heat exchanger plate stack, and permitting flow of the second fluid from the valve to the heat exchanger plate stack.

8. The heat exchanger apparatus of claim 6, further comprising a valve coupled to the heat exchanger plate stack, and permitting flow of the second fluid from the valve to the heat exchanger plate stack.

9. The heat exchanger apparatus of claim 8, wherein the valve is coupled to the heat exchanger plate stack at an end opposed to the end with the deflector plate.

10. A heat exchanger deflector plate comprising:

a first hole defining a first fluid inlet, a second hole defining a first fluid outlet, a third hole defining a second fluid inlet, and a fourth hole defining a second fluid outlet;

a central planar portion including a first planar surface located on a first side of the plate and defining a plane, a second planar surface located on a second side of the plate and defining a plane, the first surface facing a first direction, and the second surface facing a second direction which is opposite the first direction;

a plurality of bosses, each of the bosses comprising a planar portion, the planar portion having a first planar surface and a second planar surface, the first planar surface located on the first side of the plate and defining a plane, the second planar surface located on the second side of the plate and defining a plane;

wherein the plurality of bosses includes a pair of first bosses, each of the first bosses extending from the central planar portion such that the planes of the first bosses are spaced in the first direction from the planes of the central planar portion, wherein the first hole is provided through the planar portion of one of the first bosses, and the second hole is provided through the planar portion of the other first boss;

wherein the plurality of bosses includes a pair of second bosses, each of the second bosses extending from the central planar portion such that the planes of the second bosses are spaced in the second direction from the planes of the central planar portion, wherein the third hole is provided through the planar portion of one of the second bosses, and the second hole is provided through the planar portion of the other first boss;

wherein the plurality of bosses includes a pair of third bosses, each of the third bosses extending from the central planar portion, one of the first bosses, and one of the second bosses such that the planes of the third bosses are spaced in the first direction from the planes of the central planar portion and in the second direction from the planes of the first bosses;

wherein the plurality of bosses includes a fourth boss, the fourth boss surrounding the pair of first bosses, the pair of second bosses, and the pair of third bosses, and wherein the planes of the fourth boss are substantially the same as the planes of the second bosses;

wherein each of the third bosses defines a channel on the second side of the plate between one of the second bosses and the fourth boss;

wherein the plurality of bosses includes a fifth boss, the fifth boss surrounding the fourth boss, and wherein the planes of the fifth boss are substantially the same as the planes of the first bosses; and a first deflector coupled to and extending from one of the second bosses.

11. The heat exchanger deflector plate according to claim 10, further comprising a second deflector coupled to and extending from the other of the second bosses.

12. The heat exchanger deflector plate according to claim 11, wherein the first deflector and the second deflector has an arcuate profile and extends in the first direction from the planes of the central planar portion.

13. The heat exchanger deflector plate according to claim 12, wherein the first deflector is coupled and extends from an edge of one of the second bosses proximate to the central planar portion; and the second deflector is coupled to and extends from an edge of other of the second bosses proximate to the central planar portion.

14. The heat exchanger deflector plate according to claim 10, wherein each of the third bosses extends from the central planar portion to define a step, the steps being located at an end of the plate opposite from the first and second holes.

15. The heat exchanger plate according to claim 10, further comprising dimples or ribs on the central planar portion.

16. The heat exchanger plate according to claim 15, wherein the dimples or ribs permit a U-shaped flow path of the first fluid from the first fluid inlet to the first fluid outlet.

17. A heat exchanger apparatus comprising:

a heat exchanger plate stack, the plate stack comprising a plurality of heat exchanger plates connected together, wherein at least one of the heat exchanger plates is the heat exchanger deflector plate according to claim 10.

18. The heat exchanger apparatus of claim 17, further comprising a base plate, and wherein the plates of the plurality of heat exchanger plates connected together to form the heat exchanger plate stack comprise the heat exchanger plate according to claim 1, and wherein the deflector plate is connected to an end of the plate stack, and the base plate is connected to the deflector plate.

19. The heat exchanger apparatus of claim 17, further comprising a valve coupled to the heat exchanger plate stack, and permitting flow of the second fluid from the valve to the heat exchanger plate stack.

20. The heat exchanger apparatus of claim 18, further comprising a valve coupled to the heat exchanger plate stack, and permitting flow of the second fluid from the valve to the heat exchanger plate stack.

21. The heat exchanger apparatus of claim 20, wherein the valve is coupled to the heat exchanger plate stack at an end opposed to the end with the deflector plate.

* * * * *